US008534999B2

(12) United States Patent
Stephan et al.

(10) Patent No.: US 8,534,999 B2
(45) Date of Patent: Sep. 17, 2013

(54) GAS TURBINE

(75) Inventors: Bruno Stephan, Kirchdorf (CH); Jörg Krückels, Birmenstorf (CH); Thomas Sommer, Basel (CH)

(73) Assignee: ALSTOM Technology Ltd, Baden (CH)

( * ) Notice: Subject to any disclaimer, the term of this patent is extended or adjusted under 35 U.S.C. 154(b) by 622 days.

(21) Appl. No.: 12/871,353

(22) Filed: Aug. 30, 2010

(65) Prior Publication Data

US 2011/0058940 A1 Mar. 10, 2011

(30) Foreign Application Priority Data

Sep. 4, 2009 (EP) ..... 09169493

(51) Int. Cl.
*F03B 3/16* (2006.01)

(52) U.S. Cl.
USPC ..... 415/191; 416/DIG. 2

(58) Field of Classification Search
USPC ..... 415/185, 191, 208.1, 208.2; 416/223 R, 416/228, 241 R, 242, 243, 223 A, DIG. 2
See application file for complete search history.

(56) References Cited

U.S. PATENT DOCUMENTS

| | | | | |
|---|---|---|---|---|
| 2,258,795 | A * | 10/1941 | New | 415/194 |
| 4,968,216 | A * | 11/1990 | Anderson et al. | 415/199.5 |
| 5,393,198 | A * | 2/1995 | Noda et al. | 415/115 |
| 5,616,000 | A * | 4/1997 | Yamada et al. | 415/191 |
| 2003/0002975 | A1 | 1/2003 | Dudebout et al. | |
| 2009/0164185 | A1 | 6/2009 | Menuey | |
| 2009/0169369 | A1 * | 7/2009 | Morgan et al. | 415/174.2 |

FOREIGN PATENT DOCUMENTS

| | | |
|---|---|---|
| EP | 1227217 A2 | 7/2002 |
| EP | 2075527 A1 | 7/2009 |
| GB | 2102897 A | 2/1983 |

* cited by examiner

*Primary Examiner* — Nathaniel Wiehe
*Assistant Examiner* — Woody A Lee, Jr.
(74) *Attorney, Agent, or Firm* — Volpe and Koenig, P.C.

(57) ABSTRACT

A gas turbine is provided including a compressor, a combustion chamber, a guide vane row and a rotor airfoil row. The guide vane row includes a plurality of guide vane airfoils having a blade and an inner platform. The ratio between the pitch and the leading edge diameter of the guide vane airfoils is between 6.3-7.6 and the ratio between the platform length and the leading edge diameter of the guide vane airfoils is between 4.0-5.5.

10 Claims, 2 Drawing Sheets

GAS TURBINE

FIELD OF INVENTION

The present invention relates to gas turbines.

BACKGROUND

Gas turbines are known to comprise a compressor, a combustion chamber and a turbine.

Different gas turbines comprise a compressor, a first combustion chamber and a high pressure turbine; thus these gas turbines comprise a second combustion chamber and a low pressure turbine.

In the following particular reference will be made to high pressure turbines, it is anyhow clear that the present invention may be implemented in any kind of turbine, also not being the high pressure turbine or a turbine stage facing the combustion chamber.

Turbines have at least a guide vane row and a rotor blade row.

Each guide vane row is made of stator airfoils having an inner and an outer platform facing respective inner and outer walls of the combustion chamber; moreover the inner and outer platforms are separated from the inner and outer combustion chamber walls by an inner and an outer gap.

During operation the hot gases generated in the combustion chamber from the combustion of a fuel with the compressed air coming from the compressor, pass through the turbine to deliver mechanical power to the rotor.

As known in the art, when hot gases impinge on an obstacle, a high static pressure zone is generated.

Thus, as during operation the hot gases passing through the turbine impinge on the guide vane airfoils, in the zone upstream of the guide vane row a high static pressure zone is generated.

In particular the high static pressure is not uniform, but has peaks in correspondence with the leading edges of the guide vane airfoils.

This effect is particularly relevant in the first guide vane row after the combustion chamber.

In addition, the hot gases path (i.e. the duct wherein the hot gases generated in the combustion chamber pass through) has a first constricting cross section zone followed by a second expanding cross section zone followed by a third constricting cross section zone.

In the second expanding cross section zone a transition between the combustion chamber and the platforms of the guide vane airfoils is provided.

It is clear that this expanding portion makes the hot gases static pressure in the transition zone between the combustion chamber and the guide vane platforms (i.e. in the zone upstream of the leading edges of the guide vane blades) to further increase.

Such high static pressure causes the risk that hot gases enter the gaps, and damage the components nearby (so-called "gas ingestion").

Because of the particular shape of the hot gases path, this risk is mainly relevant at the inner gap.

SUMMARY

The disclosure is directed to a gas turbine including at least a combustion chamber, a guide vane row and a rotor airfoil row. The guide vane row includes a plurality of guide vane airfoils including a blade and an inner platform. A ratio between a pitch and a leading edge diameter of the guide vane airfoils is between 6.3-7.6 and a ratio between a platform length and the leading edge diameter of the guide vane airfoils is between 4.0-5.5. The platform length is defined by the axial distance between a leading edge of a guide vane blade and an inner guide vane platform inlet measured at half height of the guide vane blade.

BRIEF DESCRIPTION OF THE DRAWINGS

Further characteristics and advantages of the invention will be more apparent from the description of a preferred but non-exclusive embodiment of the gas turbine according to the invention, illustrated by way of non-limiting example in the accompanying drawings, in which.

DETAILED DESCRIPTION OF THE PREFERRED EMBODIMENTS

Introduction to the Embodiments

Figure 1:
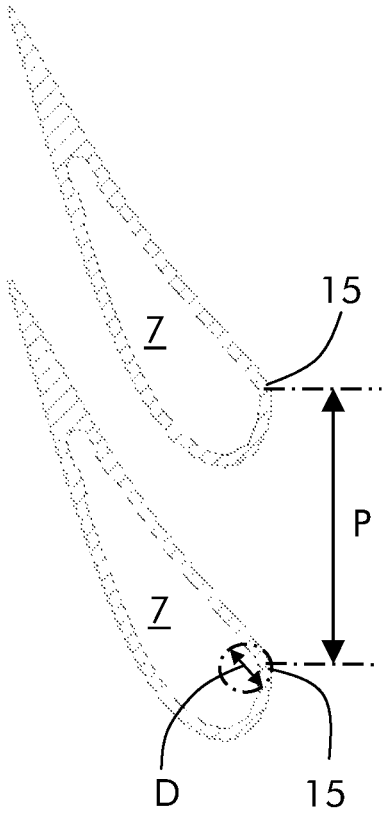
FIG. 1 is a schematic cross section of two guide vane airfoils (at half height of the guide vanes)

The technical aim of the present invention is therefore to provide a gas turbine by which the said problems of the known art are eliminated or sensibly reduced.

Within the scope of this technical aim, an object of the invention is to provide a gas turbine by which the risk of gas ingestion caused by the high static pressure upstream of the guide vane airfoil leading edges, in particular in the inner gap between the combustion chamber and the guide vane row, is very low.

The reliability of the gas turbine is thereby increased with respect to traditional gas turbines.

The technical aim, together with these and further objects, are attained according to the invention by providing a gas turbine in accordance with the accompanying claims.

DETAILED DESCRIPTION

With reference to the figures, shown are a portion of a gas turbine that comprises a compressor (not shown), a combustion chamber 2 (partially shown) and a turbine stage immediately downstream of the combustion chamber 2 that comprises a guide vane row 3.

The combustion chamber 2 has an annular shape and is defined by an inner wall 4 and an outer wall 5.

The guide vane row 3 comprises a plurality of guide vane airfoils each having a blade 7, an inner platform 8 and an outer platform 9; the inner platforms 8 of the adjacent guide vane airfoils in combination with the outer platforms 9 of the adjacent guide vane airfoils define an annular hot gases path.

Between the combustion chamber inner wall 4 and the guide vane inner platform 8 there is provided an inner gap 11; correspondingly between the combustion chamber outer wall 5 and the guide vane outer platform 9 there is provided an outer gap 12.

Downstream of the guide vane row 3 a rotor airfoil row is provided; the rotor airfoil row is not shown.

FIG. 1 shows pitch P, being the circumferential distance between the leading edges 15 of two adjacent guide vane blades 7 and the leading edge diameter D, being the diameter of the guide vane blade 7 at the leading edge 15; these parameters are measured at half height of the guide vane blade 7.

Figure 2:
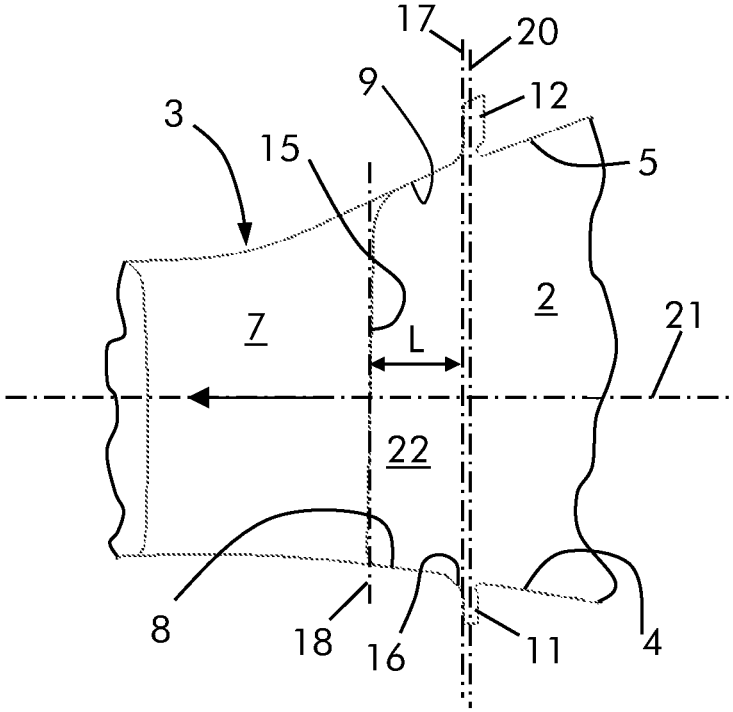
FIG. 2 is a sketch showing a hot gases path in an embodiment of the invention.

Moreover, FIG. 2 shows the platform length L at the inner diameter, being the axial distance measured at half height of the guide vane blade 7 between the leading edge 15 of a guide vane blade 7 and the guide vane inner platform inlet 16.

Advantageously, the ratio between the pitch P and the leading edge diameter D of the guide vane airfoils is between 6.3-7.6, preferably between 6.7-7.1 and more preferably 6.8-7.0.

Moreover, the ratio between the platform length L and the leading edge diameter D of the guide vane airfoils is between 4.0-5.5, preferably between 4.5-5.0 and more preferably 4.6-4.8.

In addition, the area of the gas path at least in the zone of the first guide vane row 3 continuously decreases.

FIG. 2 shows a plane 17 defining the cross section of the hot gases path at the platform inlet 16 and a plane 18 defining the cross section of the hot gases path at the leading edges 15 of the guide vane blades 7.

Advantageously, the annulus constriction in the zone of the first guide vane row 3, defined by the ratio between the hot gases path area at the cross section defined by the plane 17 and the hot gases path area at the cross section defined by the plane 18, is comprised between 1.0-1.5, preferably 1.1-1.4 and more preferably 1.2-1.3.

Advantageously this annulus constriction provides a hot gases path cross section that is continuously decreasing, thereby avoiding expanding zones wherein the static pressure of the hot gases increases.

Moreover, the inner gap 11 and the outer gap 12 are aligned with each other with respect to a plane 20 perpendicular to the gas turbine axis 21.

The operation of the gas turbine of the invention is apparent from that described and illustrated and is substantially the following.

A fuel/compressed air mixture is combusted in the combustion chamber 2 forming hot gases that flow through the hot gases path and, in particular, pass through the guide vane row 3.

In a zone 22 of the hot gases path upstream of the guide vane airfoils, the static pressure of the hot gases that impinge on the guide vane blades 7 increases.

Nevertheless as the gap 11 is far away from the leading edges 15 of the guide vane blades 7, the high static pressure does not cause (or causes in a very limited amount) the hot gases to enter into the inner gap 11.

In addition, only a low amount of hot gases enters into the outer gap 12 because of the shape of the outer platform and because of the distance between the leading edges 15 of the guide vane blades 7 and the outer gap 12.

Moreover, the fact that the hot gases path cross section continuously decreases, in particular in the zone upstream of the guide vane row 3, helps to reduce the hot gases static pressure upstream of the guide vane row 3 and, in addition, to increase the stability of the hot gases flow and to counteract the flow separation.

Figure 3:
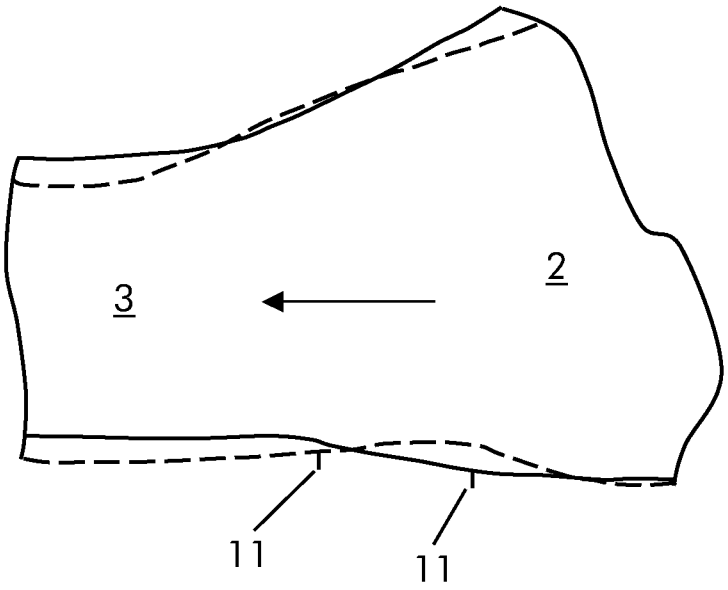
FIG. 3 shows a hot gases path in an embodiment of the invention as compared to a hot gases path of the prior art.

In this respect FIG. 3 shows the profile of the hot gases path in the zone between the end of the combustion chamber 2 and the guide vane row 3 for an embodiment of the gas turbine according to the invention and according to the prior art.

In particular, in FIG. 3 the continuous line indicates the profile of the hot gases path of the embodiment of the invention, and the dashed line the profile of the hot gases path of an embodiment of the prior art; moreover in FIG. 3 also the positions of the gap 11 in the embodiment of the invention and prior art are indicated.

FIG. 3 clearly shows that in the embodiment of the invention the gap 11 is located in a constricting cross section zone of the hot gases path, whereas according to the prior art the gap 11 is located in an expanding cross section zone of the hot gases path.

The gas turbine conceived in this manner is susceptible to numerous modifications and variants, all falling within the scope of the inventive concept; moreover all details can be replaced by technically equivalent elements.

In practice the materials used and the dimensions can be chosen at will according to requirements and to the state of the art.

REFERENCE NUMBERS

2 combustion chamber
3 guide vane row
4 inner wall of the combustion chamber
5 outer wall of the combustion chamber
7 blade of the guide vane airfoil
8 inner platform of the guide vane airfoil
9 outer platform of the guide vane airfoil
11 inner gap between 4 and 8
12 outer gap between 5 and 9
15 leading edge of the guide vane blade
16 platform inlet
17 hot gases path cross section at the platform inlet 16
18 hot gases path cross section at the leading edges 15
20 plane perpendicular to the gas turbine axis 21
21 gas turbine axis
22 hot gases path zone upstream of the guide vane row 3
P pitch
D leading edge diameter of the guide vane blade
L platform length

What is claimed is:

1. Gas turbine comprising at least a combustion chamber (2), a guide vane row (3) and a rotor airfoil row, said guide vane row (3) comprising a plurality of guide vane airfoils comprising a blade (7) and an inner platform (8), wherein a ratio between a pitch (P) and a leading edge diameter (D) of the guide vane airfoils is between 6.3-7.6 and a ratio between a platform length (L) and the leading edge diameter (D) of the guide vane airfoils is between 4.0-5.5, the platform length (L) is defined by the axial distance between a leading edge (15) of a guide vane blade (7) and an inner guide vane platform inlet (16) measured at half height of the guide vane blade (7).

2. Gas turbine as claimed in claim 1, wherein the ratio between the pitch (P) and the leading edge diameter (D) of the guide vane airfoils is between 6.8-7.0.

3. Gas turbine as claimed in claim 1, wherein the ratio between the pitch (P) and the leading edge diameter (D) of the guide vane airfoils is between 6.7-7.1.

4. Gas turbine as claimed in claim 1, wherein the ratio between the platform length (L) and the leading edge diameter (D) of the guide vane airfoils is between 4.5-5.0.

5. Gas turbine as claimed in claim 1, wherein the ratio between the platform length (L) and the leading edge diameter (D) of the guide vane airfoils is between 4.6-4.8.

6. Gas turbine as claimed in claim 1, wherein the area of the gases path in the zone of the first guide vane row (3) continuously decreases.

7. Gas turbine as claimed in claim 6, wherein an annulus constriction in the zone of the first guide vane row (3) is between 1.0-1.5, wherein the annulus constriction is defined by a ratio between a hot gases path area at a cross section of the platform inlet (16) and a hot gases path area at the leading edges (15) of the guide vane blades (7).

8. Gas turbine as claimed in claim 6, wherein an annulus constriction in the zone of the first guide vane row (3) is between 1.1-1.4, wherein the annulus constriction is defined by a ratio between a hot gases path area at a cross section of the platform inlet (16) and a hot gases path area at the leading edges (15) of the guide vane blades (7).

9. Gas turbine as claimed in claim 6, wherein an annulus constriction in the zone of the first guide vane row (3) is between 1.2-1.3, wherein the annulus constriction is defined by a ratio between a hot gases path area at a cross section of the platform inlet (16) and a hot gases path area at the leading edges (15) of the guide vane blades (7).

10. Gas turbine as claimed in claim 1, wherein the inner platform (8) of said guide vane airfoils define with an inner wall (4) of the combustion chamber (2) an inner gap (11), wherein the guide vane airfoils include an outer platform (9) defining, with an outer wall (5) of the combustion chamber (2), an outer gap (12), the inner gap (11) and the outer gap (12) are aligned with each other with respect to a plane (20) perpendicular to the gas turbine axis (21).

* * * * *